US005205925A

United States Patent [19]

Shong et al.

[11] Patent Number: 5,205,925

[45] Date of Patent: Apr. 27, 1993

[54] RECOVERING POLYCHLORINATED BIPHENYLS FROM SOLUTION

[75] Inventors: Robert G. Shong, Houston; Robert L. Horton, The Woodlands, both of Tex.

[73] Assignee: Texaco Inc., White Plains, N.Y.

[21] Appl. No.: 828,622

[22] Filed: Jan. 31, 1992

[51] Int. Cl.[5] ..... C10G 17/00

[52] U.S. Cl. ..... 208/262.5

[58] Field of Search ..... 208/262.5; 423/DIG. 20; 134/42

[56] References Cited

U.S. PATENT DOCUMENTS 4,619,744 10/1986 Horton ..... 204/105 R

*Primary Examiner*—Theodore Morris

*Assistant Examiner*—Walter D. Griffin

*Attorney, Agent, or Firm*—Jack H. Park; Kenneth R. Priem; Harold J. Delhommer

[57] ABSTRACT

A method of recovering polychlorinated biphenyls by mixing and reacting a soluble polymer with polychlorinated biphenyls in non-aqueous solvent to form a precipitate reaction complex of the polymer and biphenyl, and separating the precipitate from the solvent, said polymer having the formula:

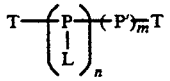

16 Claims, No Drawings

RECOVERING POLYCHLORINATED BIPHENYLS FROM SOLUTION

BACKGROUND OF THE INVENTION

This invention relates to the recovery of a hazardous class of chemicals referred to as polychlorinated biphenyls. More particularly, the invention concerns the recovery of polychlorinated biphenyls from solution.

Compounds likely to accompany polychlorinated biphenyls in contaminated sites include polychlorinated alkylbiphenyls, polychlorinated polyalkylbiphenyls, polychlorinated triphenyls, polychlorinated oligo-phenyls, and polychlorinated polyphenyls, and metabolites of polychlorinated biphenyls, polychlorinated triphenyls, polychlorinated oligo-phenyls, and polychlorinated polyphenyls and others. The terms "PCB" and "polychlorinated biphenyls" as used herein are intended to be synonymous broad terms, including not only polychlorinated biphenyls themselves, but also related compounds which may accompany polychlorinated biphenyls in various processes or at contaminated sites.

PCB was known before the turn of the century. Although the useful industrial properties of mixtures obtained by chlorination of biphenyl were recognized early, PCB is relatively unreactive chemically. Therefore, from a purely chemical point of view, PCB is a rather uninteresting class of compounds. Limited attention was paid to them by the scientific community. However, in the mid 1960's, several publications noted the widespread occurrence of these compounds in the environment and the following events led to a dramatic upsurge of attention to PCB. It is now established that because of its lipid solubility (lipophilicity) and resistance to degradation, PCB accumulates in food chains and is distributed worldwide, like chlorinated pesticides such as DDT.

The literature on PCB is growing rapidly due to concern about PCB contamination of the environment. One result has been strict United States EPA standards on contamination. However, the removal of PCB from food chains is just one example of a broad need for methods of recovery of trace PCB contaminants from dilute aqueous and non-aqueous solution.

Prior art procedures for recovery of PCB include a variety of methods. One solution has been the reaction of PCB with hydroxylating agents. Unfortunately, such procedures are not always capable of effectively contacting and recovering PCB, especially when PCB is present only in trace quantities or in dilute solution. Furthermore, current PCB recovery strategies are expensive in terms of energy demand and time.

U.S. Pat. No. 4,619,744 teaches that heavy metals can be efficiently recovered from aqueous solutions by several novel methods involving interaction of the metals with water-soluble polymers. Unfortunately, the interactions between PCB and polymers are quite unlike those between heavy metals and polymers. Therefore, while a similar approach applicable to PCB was imagined at the time of the invention which led to U.S. Pat. No. 4,619,744, no such approach Was found by the inventors. This resulted in part from the extreme unreactivity of PCB. A contributing factor was the hydrophobicity of PCB. Polymers which are soluble in non-aqueous solvents and have functional groups capable of reacting with PCB have been difficult to find.

SUMMARY OF THE INVENTION

The invention is a method of recovering polychlorinated biphenyls from solution, which comprises a multi-step of mixing and reacting a soluble polymer with polychlorinated biphenyls in non-aqueous solution to form a precipitate reaction complex of the polymer and polychlorinated biphenyls, and separating the precipitated reaction complex from the solution.

The soluble polymer contains functional groups which will interact with the polychlorinated biphenyls and has the formula:

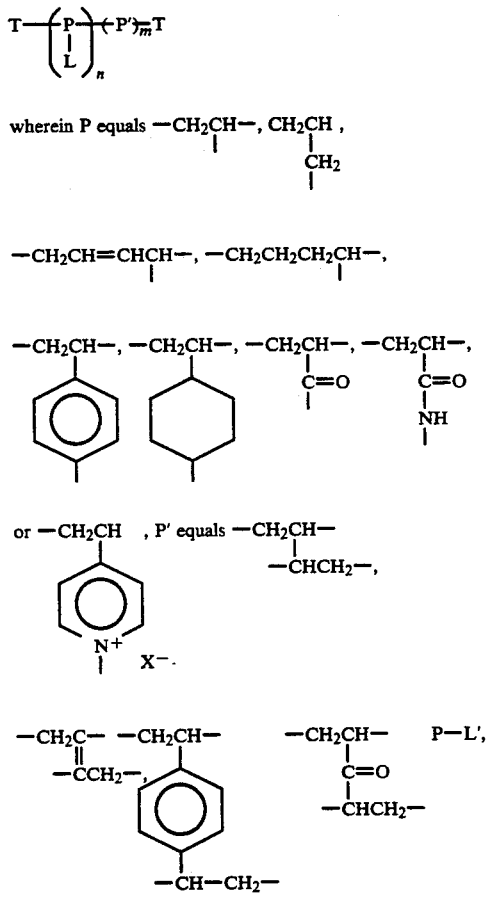

$(P-L)_y$, $P-T$, $(P-T)_y$, $P-X_y$, or $(P-X)_y$

L equals $-NR_3^+OH^-$, $-NR_3^+X^-$, $-OH$, $-O^-M^+$ $-N=C=O$, $-N=C=S$, $-COOH$, or $-COO^-M^+$, L' equals any member of the group defined by L, provided that for any given polymer, $L \neq L$, T equals H, a $C_1$–$C_{18}$ alkyl group or an alkylaryl group with about 1 to 12 carbons in the alkyl chain, R equals $C_1$–$C_4$ alkyl group, n+y equals about 2 to one million, m equals 0 to n, provided that m is selected so that the resulting polymer is suitably soluble in non-aqueous solvent, $M^+$ equals $NH_4^+$, or an alkali metal ion, and X equals Cl, Br, I, or another highly electronegative group.

DETAILED DESCRIPTION

We have discovered that PCB contaminants can be recovered from aqueous and non-aqueous solutions by reaction of the PCB contaminants with a polymer which is soluble in non-aqueous solution and which has functional groups which chemically interact with PCB. By the interaction of the polymer's functional groups and PCB, the effective molecular weight of the polymer may be increased sufficiently to cause precipitation o the PCB-polymer complex.

The PCB-polymer complex ca be collected by suitable means and contaminants recovered therefrom. Suitable means for recovery of PCB contaminants from the reaction complex include, for example, displacement of PCB from the polymer with an excess of an appropriate agent which binds to the polymer as tightly as the PCB, or displacement of PCB from the polymer with an appropriate agent which binds to the polymer more tightly than do the PCB. The PCB contaminant can then be destroyed by means well known to one skilled in the art. Alternatively, the PCB-polymer complex can be left intact and in the location of its occurrence; or the contaminant-polymer complex can be left intact but collected and subject either to perpetual containment or to destruction.

If the interaction of the polymer's functional groups and PCB does not result in the molecular weight of the PCB-polymer complex increasing sufficiently to cause precipitation, the complex will remain in solution. Precipitation can be forced by reaction of the complex with a second polymer able to complex with the PCB-polymer. The second complex can then be separated from the solution by suitable well-known means. Non-precipitated PCB-polymer reaction complexes may also be removed from solution by passing the solution through an ion exchange column packed with a strong acid type solid ion exchange resin having an affinity for the reaction complex.

The present invention provides novel methods for the recovery of PCB with molecular weights as low as about 180 to well over 600, from sites of contamination and from non-aqueous solutions containing PCB. This includes PCB compounds having as few as two phenyl groups and two chlorine substituents through those PCB compounds having many phenyl groups and chlorine substituents.

The process of the present invention involves contacting the PCB contaminants with a solution of polymer which is substituted with functional groups that interact with PCB as described in greater detail below. The non-aqueous solution must provide for dissolution of PCB, or provide for intimate contact between the polymer and PCB in order for reaction to occur. Toluene is a solvent. Other possible solvents are natural gas liquids, gas condensate, petroleum ether, mixed pentanes, n-pentane, cyclopentane, methylcyclopentane, mixed hexanes, n-hexane, cyclohexane, methylcyclohexane, naphtha, benzene, toluene, xylene and mixtures thereof.

Polymers suitable for the practice of the invention can be characterized by the formula:

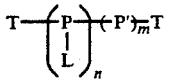

-continued wherein P equals 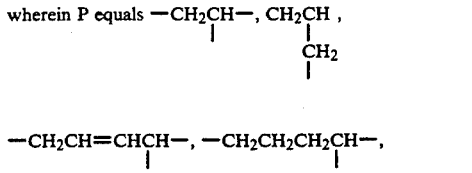

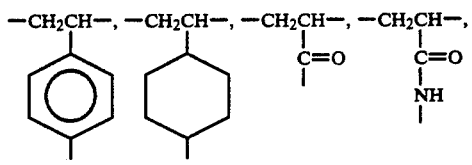

or 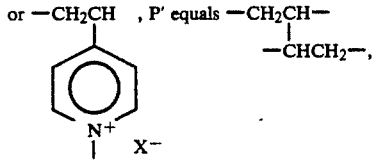 , P' equals

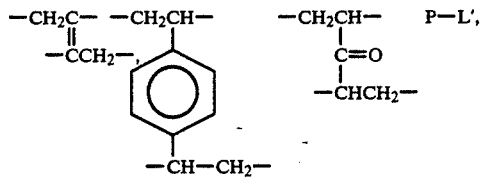

$(P-L)_y$, $P-T$, $(P-T)_y$, $P-X_y$, or $(P-X)_y$,

L equals $-NR_3^+OH^-$, $-NR_3^+X^-$, $-OH$, $-O^-M^+$ $-N=C=O$, $-N=C=S$, $-COOH$, or $-COO^-M^+$, L' equals any member of the group defined by L, provided that for any given polymer, L ≠ L, T equals H, a $C_1$–$C_{18}$ alkyl group or an alkylaryl group with about 1 to 12 carbons in the alkyl chain, R equals $C_1$–$C_4$ alkyl group, n+y equals about 2 to one million, m equals 0 to n, provided that m is selected so that the resulting polymer is suitably soluble in non-aqueous solvent, $M^+$ equals $NH_4^+$, or an alkali metal ion, and X equals Cl, Br, I, or another highly electronegative group.

The ligands L interact with PCB to form the PCB-polymer complex. The scope of P-L and P' detailed above are such as to provide a soluble polymer or copolymer in the non-aqueous solution containing PCB. Typically, P-L is a hydrophilic group while P' can be either hydrophilic or hydrophobic. By introducing hydrophobicity (decreasing the relative numbers of hydrophilic P-L groups while increasing the relative numbers of hydrophobic P' groups, or by adding in P, groups which introduce branching or crosslinking) into the soluble copolymer formulation well before additional crosslinking is introduced by the PCB-ligand interaction, the solubility of the polymer can be varied over a wide range.

It is important to select the polymer based on its solubility in the non-aqueous media containing PCB. For instance, where the PCB to be recovered is present in very low concentrations, it is desirable to choose a polymer which is almost insoluble prior to contact with the PCB to be recovered. Thus the reaction of low concentrations of PCB with the polymer will cause the polymer to precipitate out of solution.

A preferred polymer for use in the invention method is a copolymer prepared from about 60% to about 90% styrene monomer units and about 10% to about 40% glucose monomer units. A percentage of the glucose alcohol groups, preferably about 30% to about 100%, must be converted into alkoxides. This conversion can be accomplished by reaction of the copolymer with sodium.

Depending on the particular starting polymer employed, the PCB to be recovered, and the concentration of polymer and PCB, there may sometimes be substantial quantities of reacted but unprecipitated polymer left in solution with or without prior recovery of precipitate. If desired, this solution polymer can be recovered for reuse by carrying out a "non-PCB" precipitation and recovery of the resulting precipitate.

Non-PCB agents are defined herein as any appropriate agents which bind to the polymer as tightly as or more tightly than does PCB Useful non-PCB for soluble polymer recovery include catechols, resorcinols, and chlorinated benzenes, catechols and resorcinols. The polymeric portion of the non-PCB-polymer precipitate can be recovered by any suitable method known to those skilled in the art, such as partitioning the non-PCB into an immiscible solvent solution of a liquid ionic exchange agent, or by conventional aqueous-solid ion exchange.

Another method of recovering reacted but unprecipitated polymer from aqueous and non-aqueous solution is to exploit the polymer-polymer interactions known to occur between certain complimentary soluble polymers. For example, it is known that aqueous polyvinylbenzyltrimethylammonium chloride will react on contact with aqueous polyvinylsulfonic acid (sodium salt) to produce a precipitate. The two polymers are complimentary since one is anionic and the other is cationic. They mutually crosslink by forming ionic bonds. In fact, one aqueous copolymer with as little as 1% vinylbenzyltrimethylammonium chloride group content will react on contact with an aqueous copolymer with as little as 1% vinylsulfonic acid (sodium salt) group content to produce a precipitate, assuming that the unspecified 99% comonomer contents of the two copolymers do not significantly interact with each other, but are only present to interact with PCB.

Other types of complimentary polymer behavior are known to those skilled in the art such as the formation of hemiacetal, acetal, hemiketal, ketal, ester, and disulfide linkages. Crosslinking through polymer-polymer interaction is particularly useful for PCB recovery when a first polymer is loaded with PCB but is not sufficiently loaded or crosslinked to produce a precipitate. By adding a complimentary second polymer to the loaded first polymer, sufficient crosslinking can be induced to permit precipitation and recovery of the PCB contaminants.

Polymer-monomer interactions may also be used. For example, a copolymer with as little as 1% glycerol group content will react at low pH, preferably below about 5, and more preferably below about 3, with a formaldehyde or a dialdehyde such as glutaraldehyde to produce a precipitate. Upon sufficient mixing with the reaction complex solution, the aldehyde will react by crosslinking the vicinal alcohol groups of one polymer chain with those of another, increasing polymer molecular weight to the point where precipitation should occur. Ribose, glucose, and other comonomers may be substituted for the vicinal alcohol group.

An alternate invention embodiment involves mixing and reacting a hydroxylation agent with PCB in non-aqueous solvent to convert the PCB into derivatives containing at least one phenoxy or alkylphenoxy functional group. A soluble polymer is then mixed and reacted with the PCB derivatives to form a precipitate reaction complex of the soluble polymer and the PCB derivatives. The soluble polymer must contain functional groups which will interact with the phenoxy or alkylphenoxy groups of the derivatives, said functional groups having the formulae:

—COOH and —N=C=O

Possible hydroxylation agents include but are not limited to lithium methoxide, sodium t-butoxide, potassium polyvinyl alkoxide or di-tetrabutylammonium oxide.

Some of the PCB will interact with the ligand L groups, and produce a modified polymer having simple stoichiometry, such as:

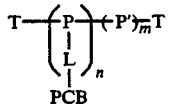

A reaction of this type is accompanied by only a small increase in polymer molecular weight, and is referred to as the "polymer loading" mode. If the original polymer was only slightly soluble, the small increase in polymer molecular weight may be sufficient to cause precipitation of the polymer.

Some of the PCB-polymer interactions will involve crosslinking of polymer chains, causing a relatively large increase in polymer molecular weight such as:

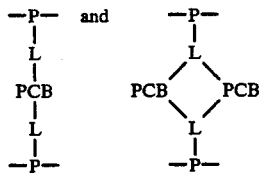

Other PCB-ligand interactions are also possible.

In the polymer loading mode, only a small increase in polymer molecular weight is obtained. In the crosslinking mode, a large increase in polymer molecular weight occurs. When sufficient crosslinking occurs and the molecular weight of the polymer is increased beyond the point where the polymer molecules can be maintained in solution, the PCB-polymer complex precipitates. Both loading and crosslinking modes of interaction may occur in the same solution.

When n and m are relatively small numbers in a polymer of low molecular weight, a great deal of crosslinking is required to cause precipitation of the polymer. Conversely, when n and m are relatively large numbers in a polymer of high molecular weight, significantly less crosslinking is required to cause polymer precipitation. Thus, the amount of polymer and the starting molecular weight of the polymer employed can be varied depending on the approximate concentration of the PCB desired to be recovered. The invention method works well with a concentration of PCB in solution between about 10 ppm and about 15,000 ppm, but this is not an exclusive range.

In accordance with the present invention, very high ratios of PCB to polymer are possible, such as 0.1 to 1 PCB molecule per monomer unit. These high loading levels can be achieved at concentrations as low as about fifty parts per million of PCB. At substantially lower PCB concentrations, the loading levels of PCB per monomer unit would be lower.

At still lower PCB concentrations of about 0.01 to about 500 ppm, the degree of crosslinking caused by PCB-ligand interaction may no longer be sufficient to precipitate the partially loaded polymer from solution. But PCB recovery can be achieved from such lo concentration solutions by appropriate modifications to the polymer employed for PCB recovery. First, a starting polymer with ligands having greater affinity for PCB may be employed. Second, a starting polymer with more branching, crosslinking, or a higher molecular weight can be employed to reduce the solubility of the initial polymer and, therefore, facilitate precipitation of the resulting PCB-polymer complex. Third, polymer-polymer or polymer-monomer complimentary reactions as previously described can be employed.

Once the PCB-polymer complex has been precipitated, the precipitate can conveniently be recovered by any suitable technique known to those skilled in the art, such as filtration, centrifugation, liquid decantation, and the like. The PCB contaminants can then be recovered from the precipitate in a variety of ways, including treating with a regenerating agent which will displace PCB from the polymer, producing a solution of unloaded, non-crosslinked polymer and a relatively concentrated solution of PCB. PCB can be extracted from the concentrated solution by other techniques such as extraction, and the regenerated polymer solution can be recycled.

The PCB-polymer precipitates produced in accordance with the invention method can also be stored in a long-term repository if desired. Thus, the method can concentrate PCB contaminants into a more manageable volume.

The following hypothetical examples will further illustrate the present invention of recovering polychlorinated biphenyls. These examples are given by way of illustration and not as limitations on the scope of the invention. Thus, it should be understood that procedures and amounts may be varied with the process still remaining within the scope of the invention.

EXAMPLE 1

A site of PCB contamination is washed with toluene producing a toluene solution containing about 10,000 ppm PCB. Next, a copolymer comprising 80% styrene monomer units and 20% glucose units is dissolved in toluene and treated with elemental sodium, liberating hydrogen gas and converting about half of the glucose alcohol groups into alkoxides. The copolymer solution is added to the PCB solution and reaction is permitted to occur. The reaction between alkoxide groups and PCB leads to hydroxylation of the PCB and linkage of the polymer chains to the PCB through phenoxy-ether linkages sufficient to both load and crosslink the polymer, causing it to precipitate from solution, cleaning the toluene of PCB. The PCB contaminated site may be repeatedly washed with new or recycled toluene a sufficient number of times to render it safe.

EXAMPLE 2

After several washings, the PCB contaminated site produces a toluene solution containing less than 100 parts per million PCB. When the copolymer solution of Example 1 is added to the PCB solution and reaction is permitted to occur, the reaction between copolymer alkoxide groups and PCB leads to hydroxylation of the PCB and loading through phenoxy-ether linkages but insufficient crosslinking of the polymer to cause precipitation. The solution is treated with acid to lower the pH and with glutaraldehyde to produce a precipitate by crosslinking the vicinal alcohol groups of one polymer chain with those of another chain. This is one way in which an extremely dilute PCB solution can be treated for reuse.

EXAMPLE 3

It is known that a non-aqueous solution of copolymer comprising 80% styrene monomer units and 20% glucose units which have been converted into alkoxides can be efficiently crosslinked and precipitated by reaction with p-dichlorobenzene. If the Example 2 solution of 100 ppm PCB does not sufficiently load or crosslink the alkoxide-containing polymer to cause precipitation, it is reasonable to expect that the polymer could be precipitated by the addition of p-dichlorobenzene to the solution. The amount of p-dichlorobenzene needs to be carefully controlled, because too little p-dichlorobenzene gives insufficient crosslinking to cause additional precipitation whereas too much p-dichlorobenzene displaces the PCB originally complexed with the polymer.

EXAMPLE 4

An alternative way of recovering the PCB-polymer complex of Example 2 containing less than 100 ppm PCB is to pass the solution through an ion exchange column packed with a strong acid type solid ion exchange resin having an affinity for the PCB-polymer reaction complex. This may remove a significant amount of nonprecipitated reaction complex. The eluant will contain a greatly attenuated PCB content.

EXAMPLE 5

As in Example 1, a site of PCB contamination is washed with toluene producing a toluene solution containing about 10,000 ppm PCB. Next, a copolymer comprising 98% styrene monomer units and 2% vinyl alcohol units is dissolved in toluene and treated with elemental sodium, liberating hydrogen gas and converting most of the vinyl alcohol groups into vinyl alkoxides. The copolymer solution is added to the PCB solution and reaction is permitted to occur. The reaction between alkoxide groups and PCB leads to hydroxylation of the PCB and linkage of the polymer chains to the PCB through phenoxy-ether linkages sufficient to both load and crosslink the polymer, causing it to precipitate from solution, cleaning the toluene of PCB. The PCB contaminated site may be repeatedly washed with new or recycled toluene a sufficient number of times to render it safe.

EXAMPLE 6

As in Example 1, a site of PCB contamination is washed with toluene producing a toluene solution containing about 10,000 ppm PCB. But before any polymer treatment, the toluene solution of PCB is treated with a hydroxylating agent such as lithium methoxide, sodium t-butoxide or di-(tetra-t-butylammonium) oxide to convert the phenyl-chloride groups in the PCB to phenolic form. Next, the phenolic PCB solution is reacted with poly-(methyl isocyanate) which converts the phenolic form to urethane linkages to the polymer. This reaction between the isocyanate groups and PCB leads to linkage of the polymer chains to the PCB through urethane linkages sufficient to both load and crosslink the polymer, causing it to precipitate from solution, cleaning the toluene of PCB. The PCB contaminated site may be repeatedly washed with new or recycled toluene a sufficient number of times to render it safe.

EXAMPLE 7

As in Example 2, a site of PCB contamination is washed with toluene producing a toluene solution containing less than about 100 ppm PCB. Before any polymer treatment, the toluene solution of PCB is first treated with a hydroxylating agent such as lithium methoxide, sodium t-butoxide or di-(tetra-t-butylammonium) oxide to convert the phenyl-chloride groups in the PCB to phenolic form. Next, the phenolic PCB solution is reacted with poly-(methyl isocyante) which converts the phenolic form to urethane linkages to the polymer. This reaction between the isocyanate groups and PCB may not lead to sufficient linkage of the polymer chains to the PCB through urethane linkages to crosslink the polymer, causing it to precipitate from solution. If needed to cause precipitation, an organic-soluble polyol such as poly-(t-butyl vinyl alcohol) could be added to the toluene solution to react with the PCB-loaded polymer and cause precipitation. The PCB contaminated site may be repeatedly washed with new or recycled toluene a sufficient number of times to render it safe.

Many other variations and modifications may be made in the concepts described above by those skilled in the art without departing from the concept of the present invention. Accordingly, it should be clearly understood that the concepts disclosed in the description are illustrative only and are not intended a limitations on the scope of the invention.

What is claimed is:

1. A method of recovering polychlorinated biphenyls from solution, which comprises:

mixing and reacting a soluble polymer with polychlorinated biphenyls in non-aqueous solvent to form a precipitate reaction complex of the soluble polymer and polychlorinated biphenyls, said soluble polymer containing functional groups which will interact with polychlorinated biphenyls and having the formula:

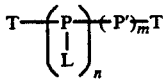

wherein P equals $-CH_2\underset{|}{C}H-$, $CH_2\underset{\underset{CH_2}{|}}{C}H$, $-CH_2CH{=}CH\underset{|}{C}H-$, $-CH_2CH_2CH_2\underset{|}{C}H-$, -continued $-CH_2\underset{|}{C}H-$, $-CH_2\underset{|}{C}H-$, $-CH_2\underset{\underset{C=O}{|}}{C}H-$, $-CH_2\underset{\underset{C=O\,NH}{|}}{C}H-$,

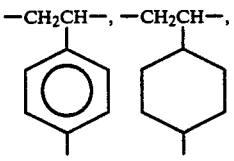

or $-CH_2\underset{|}{C}H$ , P' equals $-CH_2\underset{\underset{-CHCH_2-}{|}}{C}H-$,

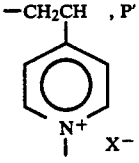

$-CH_2\underset{\underset{-CCH_2-}{\|}}{C}-$ $-CH_2\underset{|}{C}H-$ $-CH_2\underset{\underset{-CHCH_2-}{|}}{\overset{C=O}{C}}H-$ P—L',

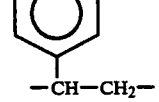

$-CH-CH_2-$ $(P-L)_y$, P—T, $(P-T)_y$, $P-X_y$, or $(P-X)_y$,

L equals $-NR_3^+OH^-$, $-NR_3^+X^-$, —OH, $-O^-M^+$ —N=C=O, —N=C=S, —COOH, or $-COO^-M^+$, L' equals any member of the group defined by L, provided that for any given polymer, L ≠ L, T equals H, a $C_1$–$C_{18}$ alkyl group or an alkylaryl group with about 1 to 12 carbons in the alkyl chain, R equals $C_1$–$C_4$ alkyl group, n+y equals about 2 to one million, m equals 0 to n, provided that m is selected so that the resulting polymer is suitably soluble in non-aqueous solvent, $M^+$ equals $NH_4^+$, or an alkali metal ion, and X equals Cl, Br, I, or another highly electronegative group; and separating the precipitated reaction complex from the solvent.

2. The method of claim 1, wherein the solvent is natural gas liquids, gas condensate, petroleum ether, mixed pentanes, n-pentane, cyclopentane, methylcyclopentane, mixed hexanes, n-hexane, cyclohexane, methylcyclohexane, naphtha, benzene, toluene, xylene or mixtures thereof.

3. The method of claim 1, wherein the concentration of polychlorinated biphenyls in solution is between about 10 ppm and about 15,000 ppm.

4. The method of claim 1, further comprising increasing the molecular weight of the soluble polymer to reduce its solubility when the concentration of polychlorinated biphenyls in solution is below about 500 ppm.

5. The method of claim 1, further comprising removing nonprecipitated reaction complex from solution by passing said solution through an ion exchange resin with an affinity for the reaction complex.

6. The method of claim 1, further comprising:

reducing the pH of the solution containing reaction complex to below about 5; and mixing formaldehyde with the reaction complex solution and allowing it to react by crosslinking the vicinal alcohol groups of different polymer chains creating a precipitate.

7. The method of claim 1, wherein the soluble polymer is a copolymer prepared from about 60% to about 90% styrene monomer units and about 10% to about 40% glucose or vinyl alcohol monomer units, having about 30% to about 100% of its alcohol groups converted into alkoxides.

8. The method of claim 7, wherein the glucose alcohol groups are converted into alkoxides by reaction with sodium.

9. The method of claim 1, further comprising recovering the polymer from reaction complex by displacing the polychlorinated biphenyls with an agent which binds to the polymer as well as PCB.

10. The method of claim 9, wherein said agent is a catechol, resorcinol, chlorinated benzene, chlorinated catechol, or chlorinated resorcinol.

11. A method of recovering polychlorinated biphenyls from solution, which comprises:

mixing and reacting a copolymer with polychlorinated biphenyls in toluene to form a precipitate reaction complex of the copolymer and polychlorinated biphenyls, said copolymer prepared from about 60% to about 90% styrene monomer units and about 10% to about 40% glucose monomer units and having about 30% to about 100% of its glucose alcohol groups converted into alkoxides by reaction with sodium; and separating the precipitated reaction complex from the toluene.

12. A method of recovering polychlorinated biphenyls from solution, which comprises:

mixing and reacting a copolymer with polychlorinated biphenyls in non-aqueous solvent to form a reaction complex of the copolymer and polychlorinated biphenyls, said copolymer prepared from about 60% to about 99% styrene monomer units and about 1% to about 40% glucose monomer units and having about 30% to about 100% of its alcohol groups converted into alkoxides;

mixing and reacting p-dichlorobenzene with the reaction complex in solution to crosslink and precipitate reaction complex; and separating the precipitated reaction complex from the solvent.

13. A method of recovering polychlorinated biphenyls from solution which comprises:

mixing and reacting a soluble polymer with polychlorinated biphenyls in non-aqueous solution to form a reaction complex of the soluble polymer and polychlorinated biphenyls, said soluble polymer containing functional groups which will interact with polychlorinated biphenyls and having the formula:

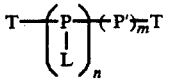

wherein P equals $-CH_2CH-$, $CH_2CH$ (with $CH_2$), $-CH_2CH{=}CHCH-$, $-CH_2CH_2CH_2CH-$, -continued

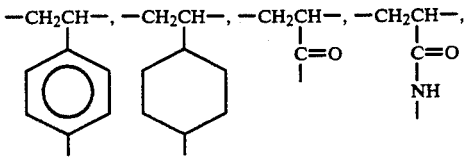

or $-CH_2CH$ , P' equals $-CH_2CH-$ $-CHCH_2-$,

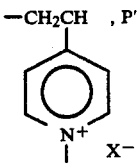

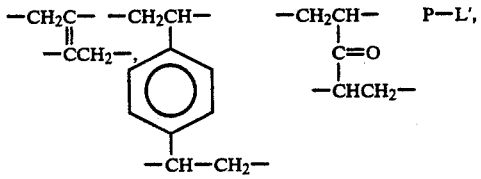

$(P-L)_y$, P—T, $(P-T)_y$, $P-X_y$, or $(P-X)_y$,

L equals $-NR_3^+OH^-$, $-NR_3^+X^-$, —OH, $-O^-M^+$ —N=C=O, —N=C=S, —COOH, or $-COO^-M^+$, L' equals any member of the group defined by L, provided that for any given polymer, L ≠ L, T equals H, a $C_1$–$C_{18}$ alkyl group or an alkylaryl group with about 1 to 12 carbons in the alkyl chain, R equals $C_1$–$C_4$ alkyl group, n+y equals about 2 to one million, m equals 0 to n, provided that m is selected so that the resulting polymer is suitably soluble in non-aqueous solvent, $M^+$ equals $NH_4^+$, or an alkali metal ion, and X equals Cl, Br, I, or another highly electronegative group;

mixing and reacting a second polymer with the reaction complex in solution, said second polymer being able to complex with the reaction complex and form a precipitate; and separating precipitate from the solution.

14. The method of claim 13, wherein the solvent is toluene, xylene, natural gas liquids, gas condensate, petroleum ether, mixed pentanes, n-pentane, cyclopentane, methylcyclopentane, mixed hexanes, n-hexane, cyclohexane, methylcyclohexane, naphtha, benzene, or mixtures thereof.

15. A method of recovering polychlorinated biphenyls from solution, which comprises:

mixing and reacting a hydroxylation agent with polychlorinated biphenyls in non-aqueous solvent to convert the polychlorinated biphenyls into derivatives containing at least one phenoxy or alkylphenoxy functional group;

mixing and reacting a soluble polymer with said derivatives in the non-aqueous solvent to form a precipitate reaction complex of the soluble polymer and said derivatives, said soluble polymer containing functional groups which will interact with the phenoxy or alkylphenoxy groups of said derivatives, said functional groups having the formulae:

—N=C=O
and
—COOH; and separating precipitate from the solvent.

16. The method of claim 15, wherein the hydroxylation agent is lithium methoxide, sodium t-butoxide, potassium polyvinyl alkoxide or di-tetrabutylammonium oxide.

* * * * *